US012679592B1

(12) United States Patent
Zheng

(10) Patent No.: US 12,679,592 B1
(45) Date of Patent: Jul. 14, 2026

(54) MODULAR STORAGE BOX

(71) Applicant: Lijun Zheng, Guangzhou (CN)

(72) Inventor: Lijun Zheng, Guangzhou (CN)

( * ) Notice: Subject to any disclaimer, the term of this patent is extended or adjusted under 35 U.S.C. 154(b) by 0 days.

(21) Appl. No.: 19/420,645

(22) Filed: Dec. 15, 2025

(51) Int. Cl.
*B65D 6/24* (2006.01)
*B65D 25/28* (2006.01)

(52) U.S. Cl.
CPC ..... *B65D 11/1873* (2013.01); *B65D 25/2802* (2013.01)

(58) Field of Classification Search
CPC ..... B65D 11/1873; B65D 25/2802; B65D 11/18; B65D 11/1866; B65D 2519/00338; B65D 2519/00587; B65D 2519/00582
USPC ..... 220/4.28, 4.31
See application file for complete search history.

(56) References Cited

U.S. PATENT DOCUMENTS

| | | | | |
|---|---|---|---|---|
| 2,091,549 | A * | 8/1937 | Kelso | A47B 47/03 312/265.5 |
| 4,782,972 | A * | 11/1988 | Wenkman | B42F 7/10 312/263 |
| 5,199,592 | A | 4/1993 | Reiland et al. | |
| 5,829,595 | A * | 11/1998 | Brown | B65D 19/0018 206/386 |
| 7,896,182 | B1 * | 3/2011 | Hansen | B65D 11/1873 220/4.31 |
| 10,118,728 | B2 | 11/2018 | Yamamoto | |
| 10,273,052 | B2 | 4/2019 | Wilcox | |
| 11,350,744 | B2 | 6/2022 | Kobayashi | |
| 11,548,682 | B2 | 1/2023 | Su | |
| 11,760,535 | B2 | 9/2023 | Dai | |
| 2004/0200832 | A1 * | 10/2004 | Moon | B65D 11/1873 220/4.28 |
| 2008/0203089 | A1 * | 8/2008 | Hartwall | B65D 19/18 108/55.3 |
| 2012/0223072 | A1 * | 9/2012 | Yamauchi | B65D 11/1873 220/4.01 |

FOREIGN PATENT DOCUMENTS

| | | | |
|---|---|---|---|
| AU | 2009335588 | B2 | 5/2014 |
| CA | 2941296 | C | 5/2019 |
| CN | 307079664 | S | 1/2022 |

(Continued)

*Primary Examiner* — Laura E. Parker
(74) *Attorney, Agent, or Firm* — Bayramoglu Law Offices LLC

(57) ABSTRACT

The present disclosure pertains to a modular storage box in the technical field of containers. The box includes a bottom plate and a side portion. An edge of the bottom plate is provided with an upward-opening insertion groove, whose side wall includes a first wedge member. A bottom surface of the side portion is provided with an insertion strip, whose lower end side wall includes a second wedge member. During assembly, inserting the strip into the groove causes the second wedge member to deflect outward via wedge-fit interaction with the first wedge member and subsequently rebound to its original position. This locks it against the first wedge member, preventing upward movement, while the groove restricts downward displacement. This vertical bidirectional locking structure significantly enhances the connection strength between the side portion and the bottom plate, thereby greatly improving the overall structural stability and firmness of the modular storage box.

7 Claims, 12 Drawing Sheets

(56) References Cited

FOREIGN PATENT DOCUMENTS

| | | | |
|---|---|---|---|
| CN | 307272536 | S | 4/2022 |
| CN | 307405663 | S | 6/2022 |
| CN | 307529645 | S | 9/2022 |
| CN | 307573655 | S | 9/2022 |
| CN | 307629002 | S | 11/2022 |
| CN | 307636031 | S | 11/2022 |
| CN | 307649450 | S | 11/2022 |
| JP | 3875057 | B2 | 1/2007 |
| JP | 3875058 | B2 | 1/2007 |
| JP | 5780873 | B2 | 9/2015 |
| JP | 5914005 | B2 | 5/2016 |
| JP | 6399599 | B2 | 10/2018 |
| JP | 7462301 | B2 | 4/2024 |
| KR | 0114281 | Y1 | 4/1998 |
| TW | 205239 | U | 5/1993 |

* cited by examiner

MODULAR STORAGE BOX

BACKGROUND

1. Technical Field

The present disclosure relates to the technical field of storage boxes, and in particular, to a modular storage box.

2. Background Information

As a commonly used storage tool in daily life and work, storage boxes are widely used for organizing and storing various items. According to their structural forms, storage boxes are generally classified into two types: integrated and modular. The integrated storage box is typically formed by integral molding, has a sturdy and durable structure, and is convenient to use. However, due to its fixed shape, it is difficult to adjust flexibly according to actual requirements, resulting in a large volume and inconvenience in transportation and storage. To address this issue, the modular storage box has emerged. The modular storage box is formed by combining a plurality of components, has high flexibility, and is convenient to disassemble and transport, thus greatly enhancing the convenience of use and carrying. However, due to a great number of components, the modular storage box has many joints, which are prone to loosening or misalignment during use, thereby reducing the overall structural stability, and affecting the service life and user experience of the product.

BRIEF SUMMARY

In view of this, the present disclosure provides a modular storage box, aiming to solve the problem of insufficient overall structural stability of the conventional modular storage box.

The present disclosure provides a modular storage box, including a bottom plate and a side portion, where the bottom plate has a planar structure, and the side portion has a vertically through structure; an edge of the bottom plate is provided with an insertion groove having an upward opening; a side wall of the insertion groove protrudes from an upper surface of the bottom plate and is provided with a first wedge member; a spacing between a wedge surface of the first wedge member and the side wall of the insertion groove increases gradually from top to bottom along a direction away from the insertion groove, starting from a position connected to the side wall of the insertion groove; a flat surface of the first wedge member is perpendicular to the side wall of the insertion groove and connected to a lower part of the wedge surface of the first wedge member; a bottom surface of the side portion is provided with an insertion strip matching the insertion groove; an upper end of the insertion strip is not flush with a left end and/or a right end of the bottom surface of the side portion, such that at least one of the left end and the right end of the bottom surface of the side portion forms a projecting portion; a position of a side wall of a lower end of the insertion strip corresponding to the first wedge member is provided with a second wedge member; a spacing between a wedge surface of the second wedge member and the side wall of the lower end of the insertion strip increases gradually from bottom to top along a direction away from the insertion strip, starting from a position connected to the insertion strip; a flat surface of the second wedge member is perpendicular to a side wall of the insertion strip and connected to an upper part of the wedge surface of the second wedge member;

when the insertion strip on the side portion is inserted into the insertion groove from the opening of the insertion groove in the bottom plate, the wedge surface of the second wedge member slides along the wedge surface of the first wedge member until the flat surface of the second wedge member is limited by the flat surface of the first wedge member; in addition, the projecting portion of the bottom surface of the side portion is blocked by the side wall of the insertion groove, such that the side portion and the bottom plate closely enclose to form an integrated box body.

In a possible embodiment, a through hole is formed in a position of a bottom wall of the insertion groove corresponding to the first wedge member.

In a possible embodiment, the integrated box body has a rectangular structure, and the bottom plate is a rectangular plate.

In a possible embodiment, the side portion includes a front plate and a rear plate arranged symmetrically front and back, and a left plate and a right plate arranged symmetrically left and right, where front and rear ends of the left plate and the right plate are each provided with a vertical groove having an opening, and left and right ends of the front plate and the rear plate are each provided with a vertical strip matching the vertical groove; and when all the vertical strips are inserted into the corresponding vertical grooves from the openings of the corresponding vertical grooves, the front plate, the left plate, the rear plate, and the right plate are sequentially connected and enclose to form a vertically through rectangular structure.

In a possible embodiment, the vertical strip includes an integrally formed strip-shaped connecting portion, and strip-shaped left strip portion and right strip portion, where the connecting portion is connected to the corresponding front plate; the left strip portion and the right strip portion are respectively located on a left side and a right side of the connecting portion; a cross section of the vertical strip is in a T shape with a vertical portion corresponding to the connecting portion and a horizontal portion corresponding to the left strip portion and the right strip portion, where an area of the horizontal portion of the T shape corresponding to the left strip portion has a large size, and an area of the horizontal portion of the T shape corresponding to the right strip portion has a small size;

the vertical groove includes an integrally formed plate-shaped bottom member, and L-shaped left groove member and right groove member, where the bottom member is connected to the corresponding left plate, a vertical portion of the left groove member is connected to a left side of the bottom member, a vertical portion of the right groove member is connected to a right side of the bottom member, and a horizontal portion of the left groove member and a horizontal portion of the right groove member are arranged separately; a spacing between the horizontal portion of the left groove member and the bottom member is greater than a spacing between the horizontal portion of the right groove member and the bottom member;

when the vertical strip is inserted into the corresponding vertical groove from the opening of the corresponding vertical groove, the left strip portion slides along the left groove member, and the right strip portion slides along the right groove member; and the connecting portion is located in a gap between the horizontal portion of the left groove member and the horizontal portion of the right groove member.

In a possible embodiment, the right strip portion includes an upper strip segment and a lower strip segment respectively located at an upper end and a lower end of the connecting portion, the upper strip segment and the lower strip segment being arranged separately from each other; and the right groove member includes an upper groove segment and a lower groove segment respectively located at an upper end and a lower end of the bottom member, the upper groove segment and the lower groove segment being arranged separately from each other.

In a possible embodiment, the modular storage box further includes a top cover for closing the integrated box body, where the top cover is detachably connected to the side portion.

In a possible embodiment, an edge of the top cover is provided with a protruding portion, and a side wall of the side portion is provided with a buckle matching the protruding portion; and when the buckle is engaged with the protruding portion, the top cover and the side portion are connected by engagement.

In a possible embodiment, the protruding portion includes at least one pair of left-right symmetrically arranged protruding members, and the buckle includes at least one pair of left-right symmetrically arranged engaging members matching the protruding members.

In a possible embodiment, a top surface of the top cover is provided with a handle.

Compared with the prior art, the present disclosure has the following beneficial effects: a modular storage box includes a bottom plate and a side portion, where the bottom plate has a planar structure, and the side portion has a vertically through structure; an edge of the bottom plate is provided with an insertion groove having an upward opening; a side wall of the insertion groove protrudes from an upper surface of the bottom plate and is provided with a first wedge member; a spacing between a wedge surface of the first wedge member and the side wall of the insertion groove increases gradually from top to bottom along a direction away from the insertion groove, starting from a position connected to the side wall of the insertion groove; a flat surface of the first wedge member is perpendicular to the side wall of the insertion groove and connected to a lower part of the wedge surface of the first wedge member; a bottom surface of the side portion is provided with an insertion strip matching the insertion groove; an upper end of the insertion strip is not flush with a left end and/or a right end of the bottom surface of the side portion, such that at least one of the left end and the right end of the bottom surface of the side portion forms a projecting portion; a position of a side wall of a lower end of the insertion strip corresponding to the first wedge member is provided with a second wedge member; a spacing between a wedge surface of the second wedge member and the side wall of the lower end of the insertion strip increases gradually from bottom to top along a direction away from the insertion strip, starting from a position connected to the insertion strip; a flat surface of the second wedge member is perpendicular to a side wall of the insertion strip and connected to an upper part of the wedge surface of the second wedge member; when the insertion strip on the side portion is inserted into the insertion groove from the opening of the insertion groove in the bottom plate, the wedge surface of the second wedge member slides along the wedge surface of the first wedge member until the flat surface of the second wedge member is limited by the flat surface of the first wedge member; in addition, the projecting portion of the bottom surface of the side portion is blocked by the side wall of the insertion groove, such that the side portion and the bottom plate closely enclose to form an integrated box body. It can be seen that, during assembly, only the insertion strip on the side portion needs to be inserted into the insertion groove in the bottom plate from top to bottom, such that the bottom plate and the side portion can closely enclose to form an integrated box body, thereby completing the assembly. This process is easy to operate and can be quickly completed with just one downward insertion action. During insertion, the second wedge member shifts slightly outward through wedge fit with the first wedge member as the insertion strip advances; and after the insertion strip is pushed into place, a force-bearing state of the wedge fit is released, and the second wedge member retracts inward to return to its original position and is limited by the first wedge member to prevent upward movement. In addition, when the insertion strip is pushed into place, due to a blocking relationship between an end of the side portion and the side wall of the insertion groove, the side portion is blocked by the insertion groove to effectively prevent further downward movement. Through this vertical bidirectional locking structure, the connection stability and firmness between the bottom plate and the side portion can be significantly improved, thereby effectively extending the service life of the modular storage box, and optimizing the overall user experience.

Figure 1:
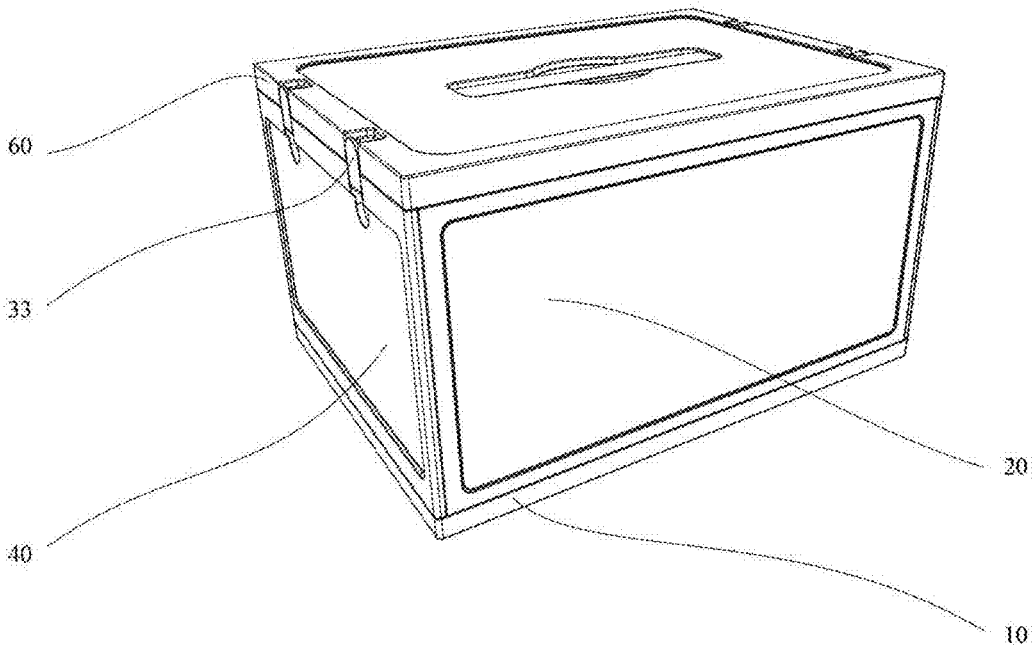
FIG. 1 is a schematic structural diagram of a modular storage box according to an embodiment of the present disclosure.

Reference numerals are described as follows:

10: bottom plate; 11: insertion groove; 12: first wedge member; 13: through hole; 20: front plate; 21: connecting portion; 22: left strip portion; 23: right strip portion; 24: upper strip segment; 25: lower strip segment; 30: rear plate; 31: insertion strip; 32: second wedge member; 33: buckle; 40: left plate; 41: bottom member; 42: left groove member; 43: right groove member; 44: upper groove segment; 45: lower groove segment; 50: right plate; 60: top cover; 61: protruding portion; and 62: handle.

DETAILED DESCRIPTION OF THE DRAWINGS AND THE PRESENTLY PREFERRED EMBODIMENTS

The technical solutions in the embodiments of the present disclosure will be clearly and completely described below with reference to the accompanying drawings in the embodiments of the present disclosure. Apparently, the described embodiments are merely some rather than all of the embodiments of the present disclosure. All other embodiments obtained by those of ordinary skill in the art based on the embodiments in the present disclosure without creative efforts shall fall within the scope of protection of the present disclosure.

It should be noted that if directional indications (such as up, down, left, right, front, back . . . ) are involved in the embodiments of the present disclosure, such directional indications are only used to explain relative positions, sliding states, etc. of components in a specific pose (as shown in the figure), and if the specific pose changes, the directional indication also changes accordingly.

In addition, if descriptions of the terms such as "first" and "second" are involved in the embodiments of the present disclosure, such descriptions are only for descriptive purposes and should not be understood as indicating or implying relative importance or implicitly specifying the quantity of the indicated technical features. Thus, features defined with "first" and "second" can explicitly or implicitly include at least one of the features. Furthermore, the technical solutions among the various embodiments may be combined with one another, but must be based on the implementation by those of ordinary skill in the art. When the combination of the technical solutions is contradictory or may not be implemented, it should be considered that such combination of the technical solutions does not exist and is not within the scope of protection of the present disclosure.

Figure 2:
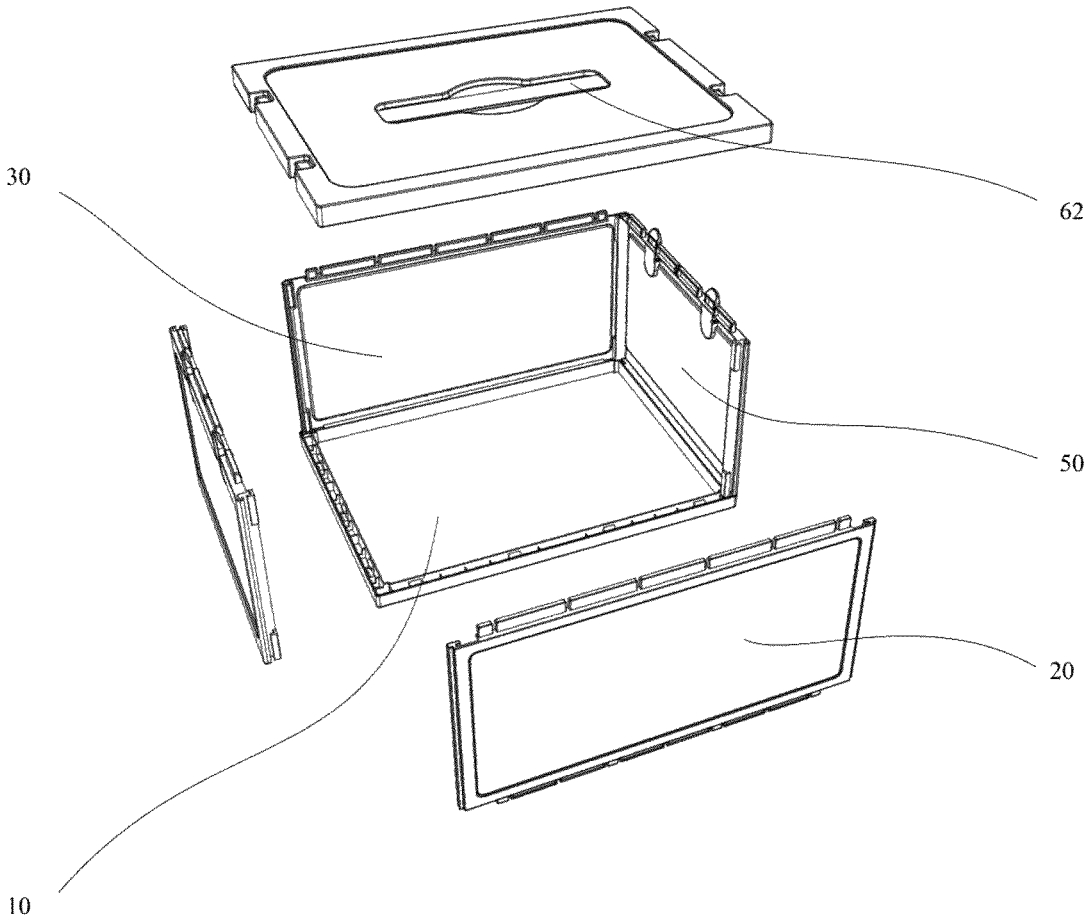
FIG. 2 is an exploded structural view of a modular storage box according to an embodiment of the present disclosure.

As shown in FIGS. 1-2, the present disclosure provides a modular storage box, including a bottom plate 10 and a side portion, where the bottom plate 10 has a planar structure, and the side portion has a vertically through structure; an edge of the bottom plate 10 is provided with an insertion groove 11 having an upward opening; a side wall of the insertion groove 11 protrudes from an upper surface of the bottom plate 10 and is provided with a first wedge member 12; a spacing between a wedge surface of the first wedge member 12 and the side wall of the insertion groove 11 increases gradually from top to bottom along a direction away from the insertion groove 11, starting from a position connected to the side wall of the insertion groove 11; a flat surface of the first wedge member 12 is perpendicular to the side wall of the insertion groove 11 and connected to a lower part of the wedge surface of the first wedge member 12; a bottom surface of the side portion is provided with an insertion strip 31 matching the insertion groove 11; an upper end of the insertion strip 31 is not flush with a left end and/or a right end of the bottom surface of the side portion, such that at least one of the left end and the right end of the bottom surface of the side portion forms a projecting portion; a position of a side wall of a lower end of the insertion strip 31 corresponding to the first wedge member 12 is provided with a second wedge member 32; a spacing between a wedge surface of the second wedge member 32 and the side wall of the lower end of the insertion strip 31 increases gradually from bottom to top along a direction away from the insertion strip 31, starting from a position connected to the insertion strip 31; a flat surface of the second wedge member 32 is perpendicular to a side wall of the insertion strip 31 and connected to an upper part of the wedge surface of the second wedge member 32;

when the insertion strip 31 on the side portion is inserted into the insertion groove 11 from the opening of the insertion groove 11 in the bottom plate 10, the wedge surface of the second wedge member 32 slides along the wedge surface of the first wedge member 12 until the flat surface of the second wedge member 32 is limited by the flat surface of the first wedge member 12; in addition, the projecting portion of the bottom surface of the side portion is blocked by the side wall of the insertion groove 11, such that the side portion and the bottom plate 10 closely enclose to form an integrated box body.

Specifically, the bottom plate 10 has a planar structure and mainly functions to support and connect the side portion. The edge of the bottom plate 10 is provided with an insertion groove 11, and the side wall of the insertion groove 11 is higher than the upper surface of the bottom plate 10 to form a three-dimensional structure, which facilitates insertion and engagement of the insertion strip 31 on the side portion. The side wall of the insertion groove 11 is provided with a first wedge member 12, and the wedge surface of the first wedge member gradually moves away from the side wall of the insertion groove 11 from top to bottom, so as to facilitate sliding fit when the insertion strip 31 on the side portion is inserted. The flat surface of the first wedge member 12 is located at the lower part of the wedge surface of the first wedge member 12 and functions to limit the insertion strip 31. The side portion has a vertically through structure and is a hollow and vertically through wall plate. The bottom surface of the side portion is provided with an insertion strip 31 matching the insertion groove 11, where the insertion strip 31 is a projecting portion for being inserted into the insertion groove 11 in the bottom plate 10. The upper end of the insertion strip 31 is not flush with the left end and/or the right end of the bottom surface of the side portion, thereby forming a projecting portion. The projecting portion is configured to establish a blocking relationship with the side wall of the insertion groove 11 (specifically, an upper edge of the side wall of the insertion groove 11), preventing the side portion from further moving downward along a direction of the insertion groove 11. The lower end of the insertion strip 31 is further provided with a second wedge member 32 matching the first wedge member 12, where an inclination direction of the wedge surface of the second wedge member 32 is opposite to an inclination direction of the wedge surface of the first wedge member 12, so as to facilitate sliding fit during insertion. The flat surface of the second wedge member 32 is located at the upper part of the wedge surface of the second wedge member 32 and can cooperate with the flat surface of the first wedge member 12 to limit the second wedge member 32. When the insertion strip 31 on the side portion is inserted into the insertion groove 11 from the opening of the insertion groove 11 in the bottom plate 10, the wedge surface of the second wedge member 32 slides along the wedge surface of the first wedge member 12 and shifts slightly outward relative to its initial position at the same time. Through the cooperation between the two wedge surfaces, the flat surface of the second wedge member 32 is guided to the lower part of the flat surface of the first wedge member 12 and limited by it. In this case, the second wedge member 32 is in a reset state. Subsequently, once the second wedge member 32 tends to move upward, it will be promptly blocked by the flat surface of the first wedge member 12. In addition, the projecting portion of the bottom surface of the side portion is also blocked by the side wall of the insertion groove 11 to prevent the side portion from further moving downward. In this way, the side portion is effectively prevented from moving up and down relative to the bottom plate 10, such that the side portion and the bottom plate can closely enclose to form an integrated box body with a stable structure. According to the modular storage box, the structure is compact and firm, automatic fastening and locking between the bottom plate 10 and the side portion during assembly are achieved through a vertically matched wedge-fit relationship and a blocking mechanism, the connection strength is effectively improved, and the durability and user experience of the product are enhanced. The modular storage box is suitable for being made of a plastic material with a certain elasticity. This material can not only satisfy the overall rigidity requirement of the product, but also ensure reliable shifting and resetting of the second wedge member 32, thereby meeting diverse application requirements.

Compared with the prior art, during assembly of the modular storage box according to the present disclosure, only the insertion strip 31 on the side portion needs to be inserted into the insertion groove 11 in the bottom plate 10 from top to bottom, such that the bottom plate 10 and the side portion can closely enclose to form an integrated box body, thereby completing the assembly. This process is easy to operate and can be quickly completed with just one downward insertion action. During insertion, the second wedge member 32 shifts slightly outward through wedge fit with the first wedge member 12 as the insertion strip 31 advances; and after the insertion strip 31 is pushed into place, a force-bearing state of the wedge fit is released, and the second wedge member 32 retracts inward to return to its original position and is limited by the first wedge member 12 to prevent upward movement. In addition, when the insertion strip 31 is pushed into place, due to a blocking relationship between an end of the side portion and the side wall of the insertion groove 11, the side portion is blocked by the insertion groove 11 to effectively prevent further downward movement. Through this vertical bidirectional locking structure, the connection stability and firmness between the bottom plate 10 and the side portion can be significantly improved, thereby effectively extending the service life of the modular storage box, and optimizing the overall user experience.

Figure 3:
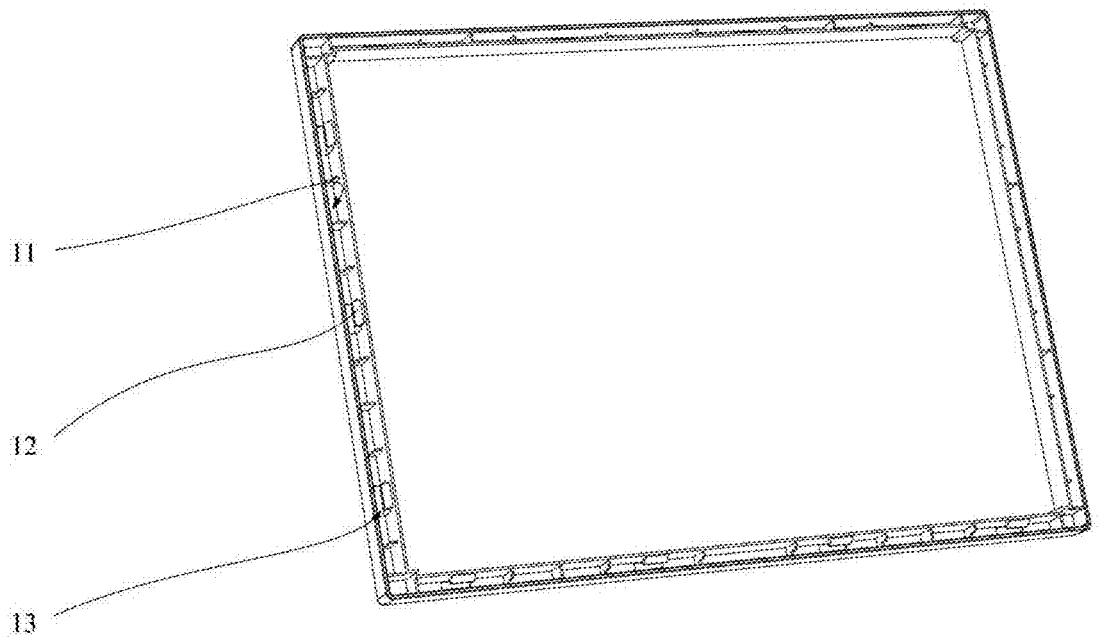
FIG. 3 is a schematic structural diagram of a bottom plate according to an embodiment of the present disclosure.
Figure 4:
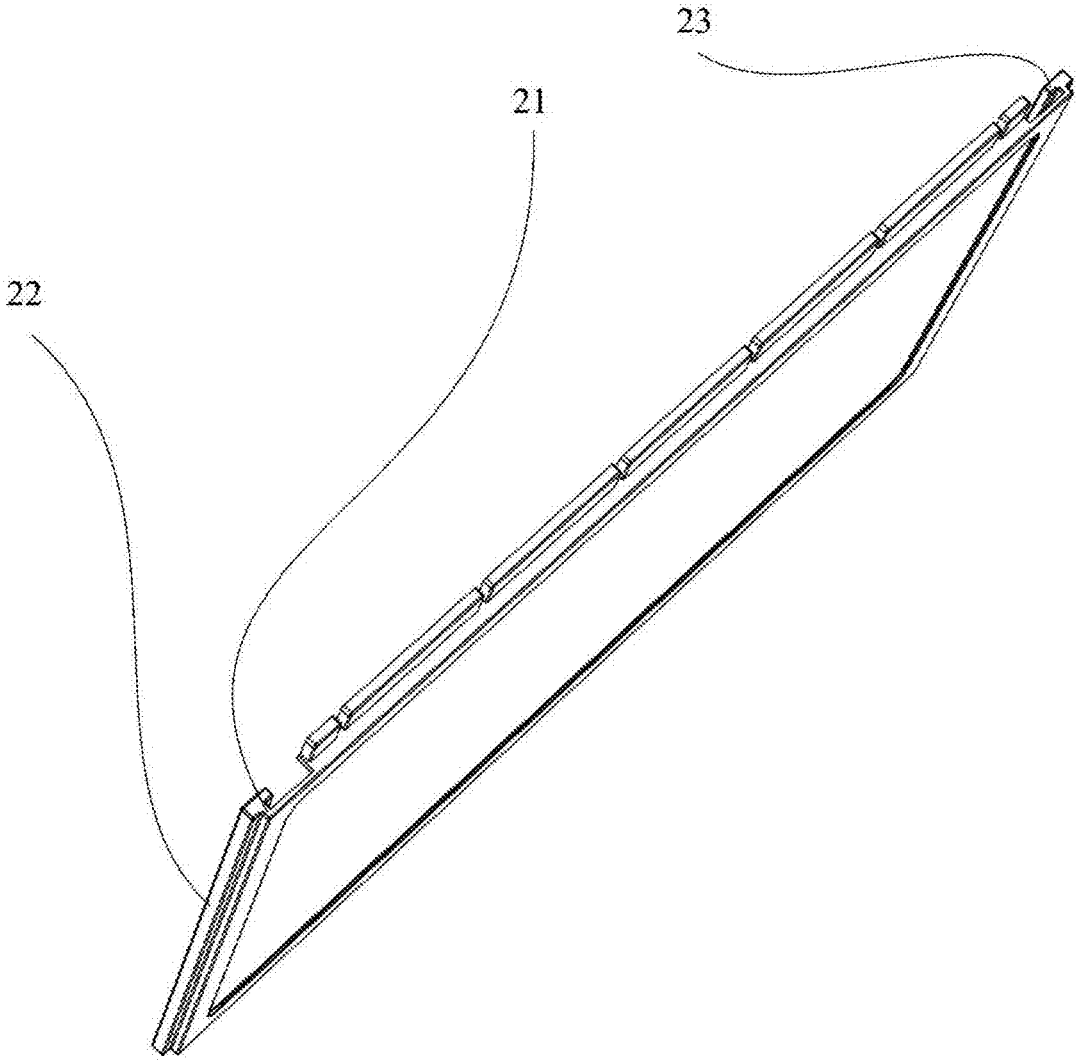
FIG. 4 is a first schematic structural diagram of a front plate according to an embodiment of the present disclosure.
Figure 5:
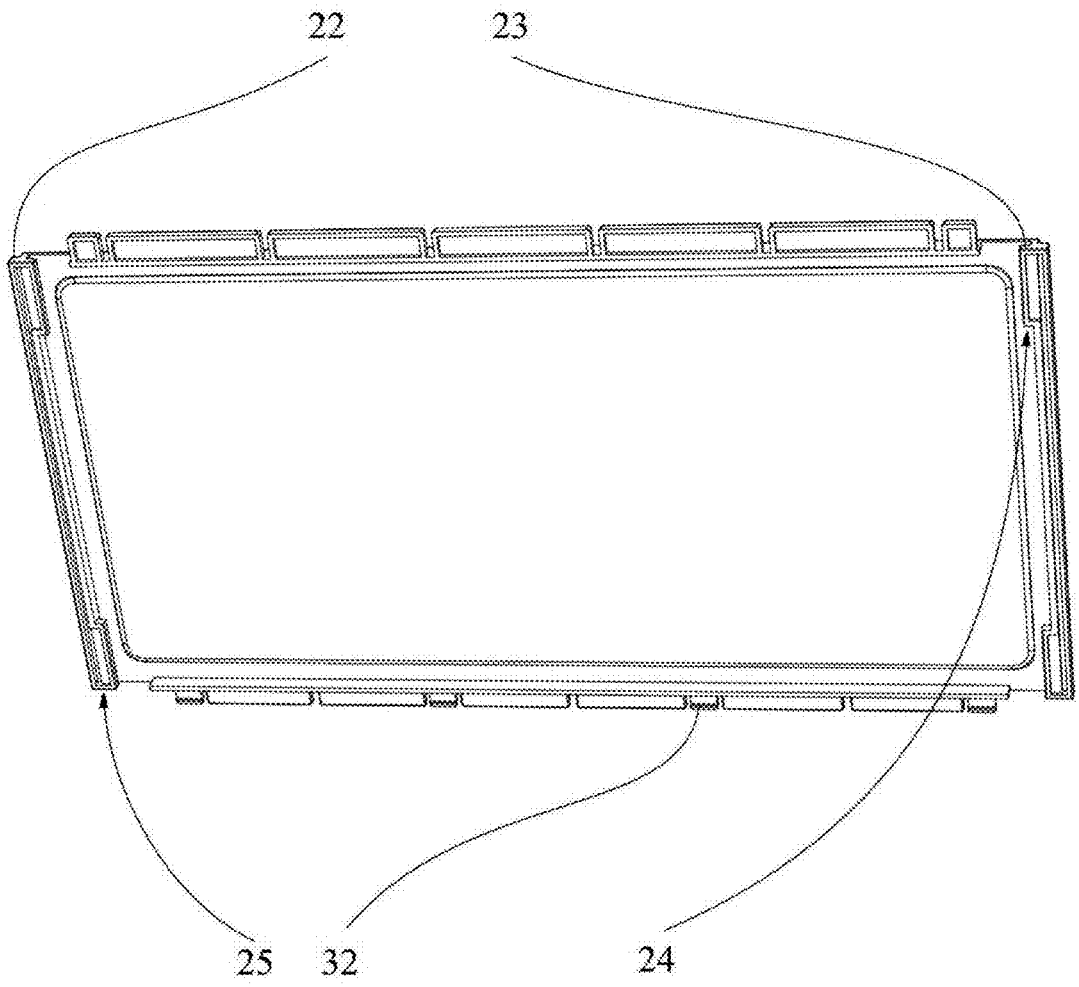
FIG. 5 is a second schematic structural diagram of a front plate according to an embodiment of the present disclosure.
Figure 6:
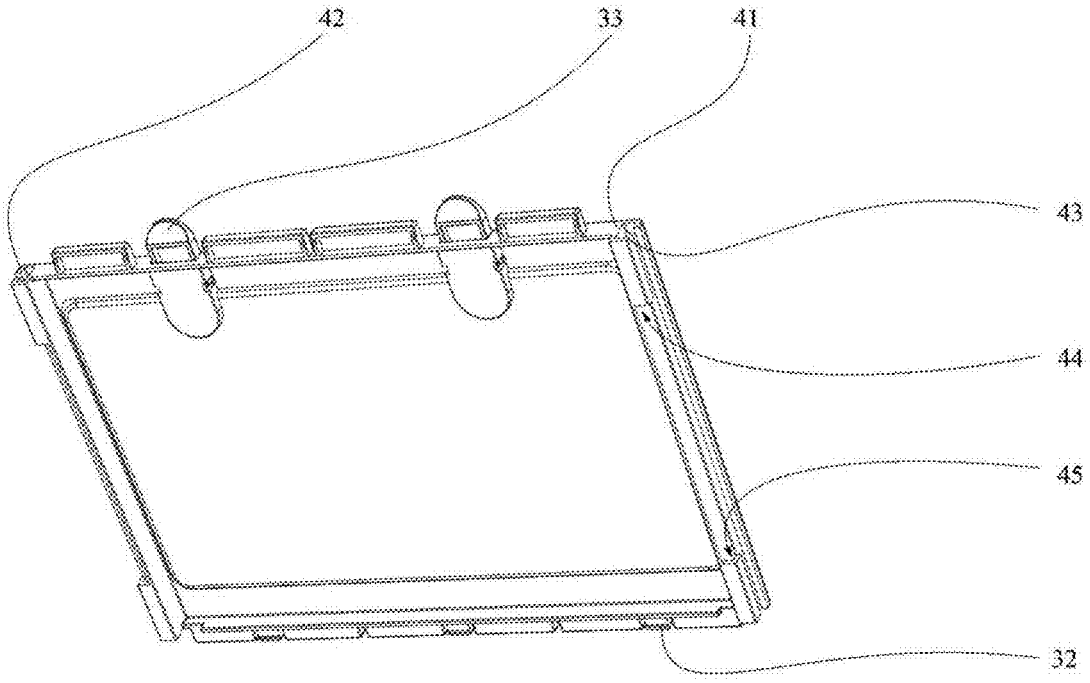
FIG. 6 is a first schematic structural diagram of a left plate according to an embodiment of the present disclosure.
Figure 7:
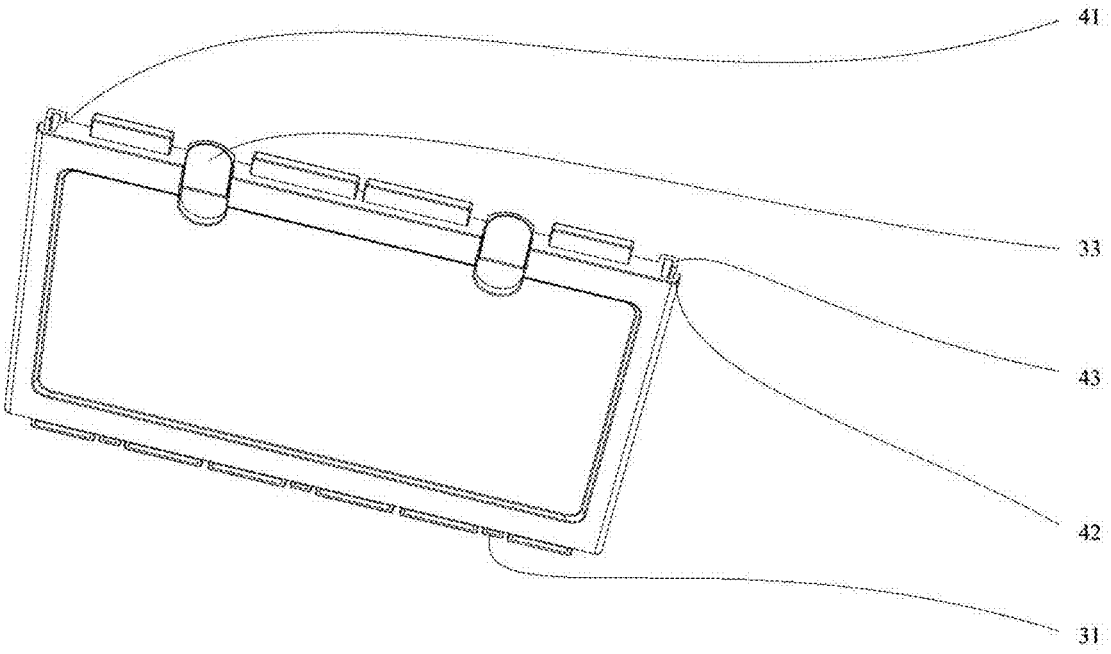
FIG. 7 is a second schematic structural diagram of a left plate according to an embodiment of the present disclosure.
Figure 8:
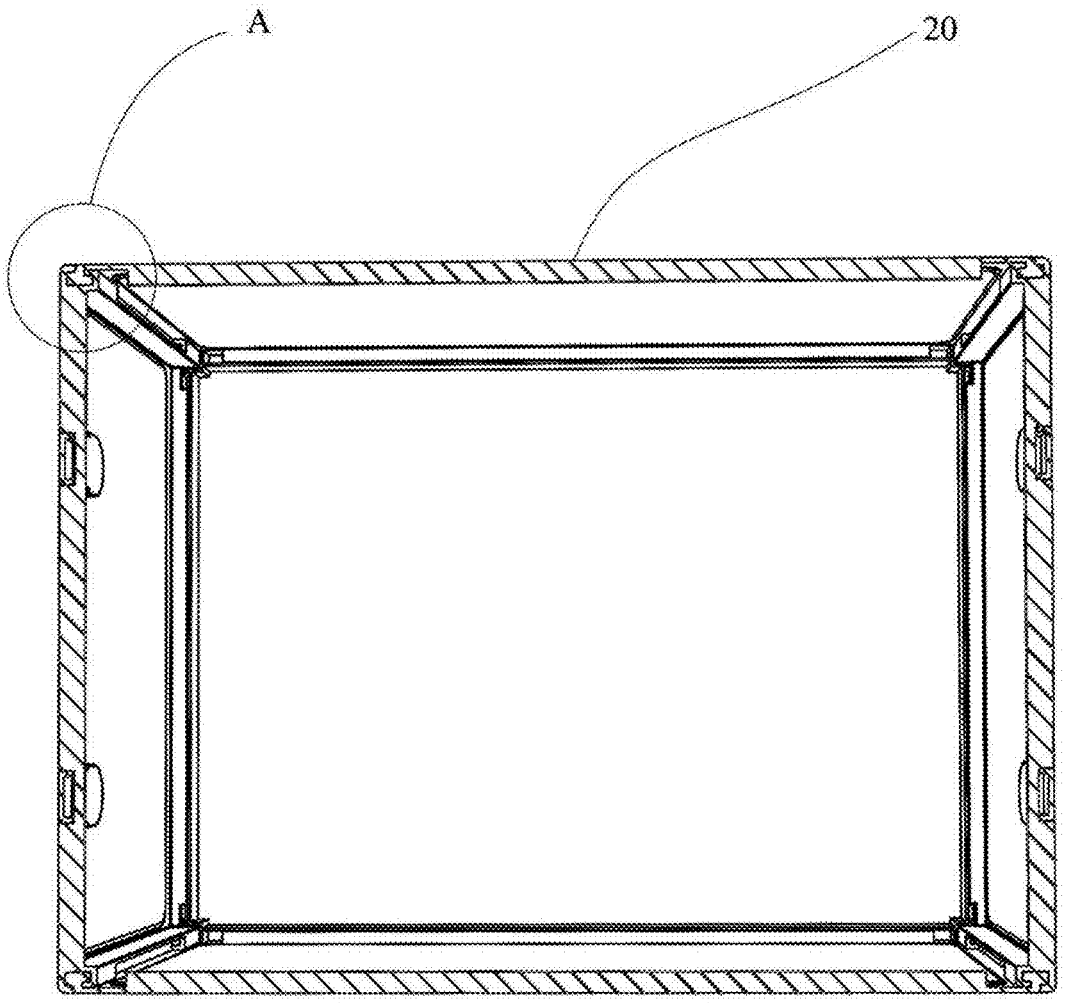
FIG. 8 is a transverse cross-sectional view of a modular storage box according to an embodiment of the present disclosure.
Figure 9:
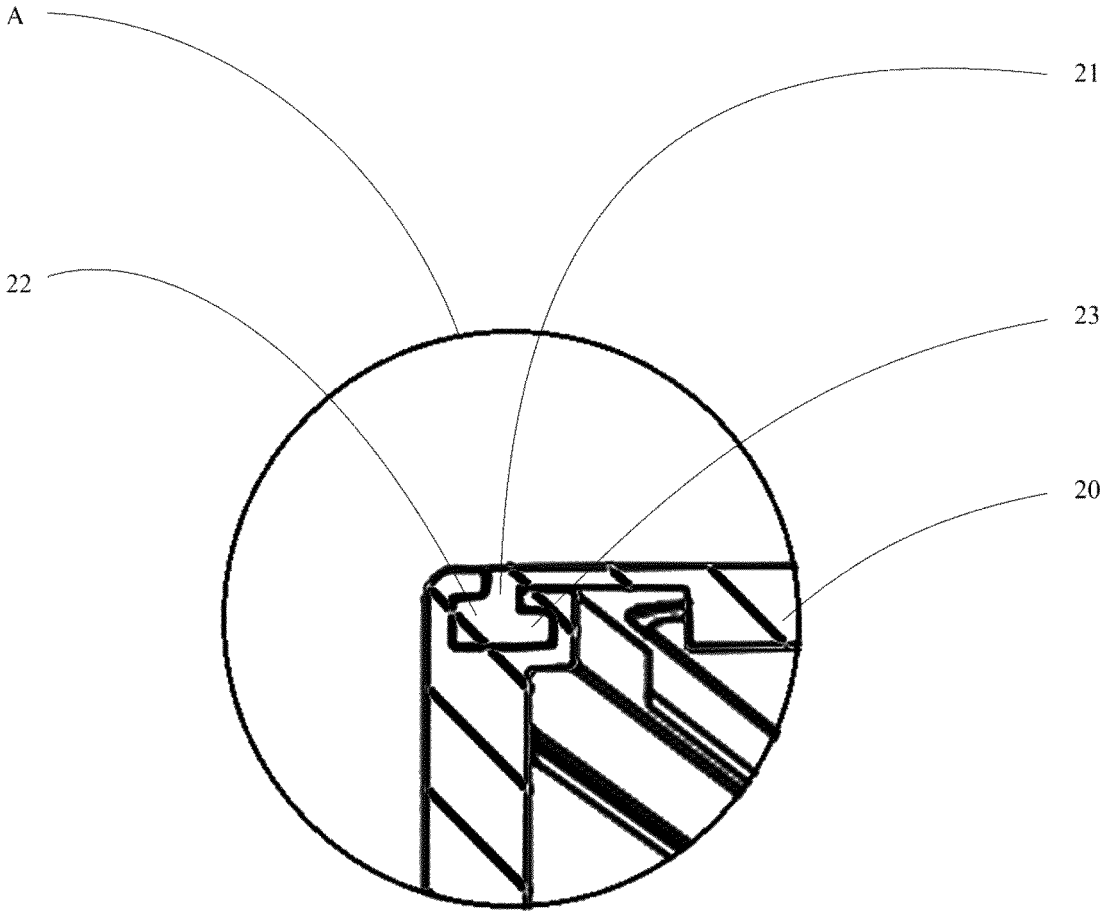
FIG. 9 is a schematic structural diagram of a local part A in FIG. 8.
Figure 10:
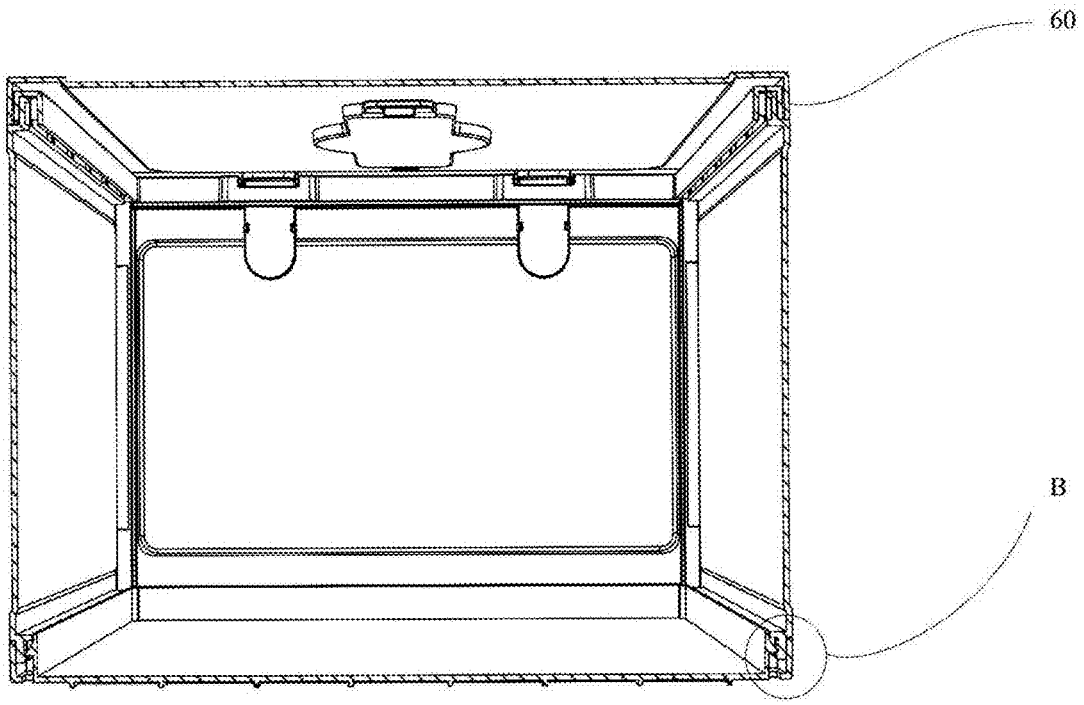
FIG. 10 is a longitudinal cross-sectional view of a modular storage box according to an embodiment of the present disclosure.
Figure 11:
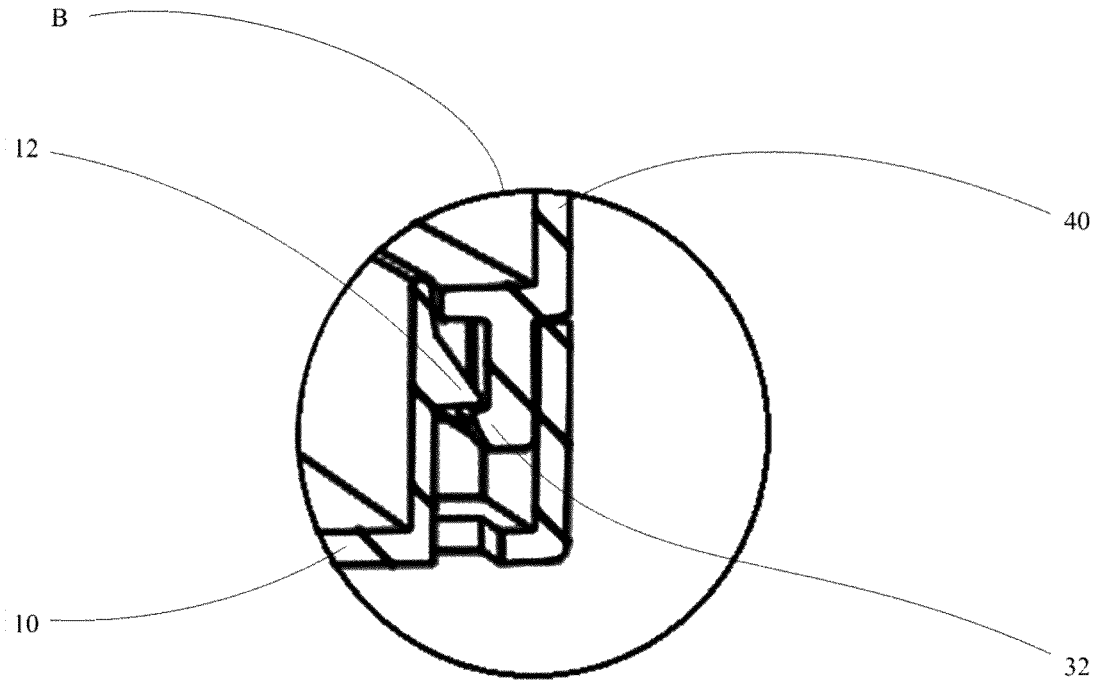
FIG. 11 is a schematic structural diagram of a local part B in FIG. 10.

As shown in FIG. 3, in some embodiments of the present disclosure, a through hole 13 is formed in a position of a bottom wall of the insertion groove 11 corresponding to the first wedge member 12.

Specifically, dust, debris, or other impurities tend to accumulate inside the insertion groove 11, especially at the bottom wall, thereby affecting smooth cooperation between the insertion strip 31 and the insertion groove 11. Thus, the through hole 13 is formed in the position of the bottom wall of the insertion groove 11 corresponding to the first wedge member 12, which can not only serve as an outlet to effectively prevent dust accumulation and keep a mating surface clean, but also facilitate observing a mating state between the first wedge member 12 and the second wedge member 32. In addition, the formation of the through hole 13 can also reduce the overall structural weight, alleviate local stress concentration, and enhance product performance and ease of use.

As shown in FIGS. 4-7, in some embodiments of the present disclosure, the integrated box body has a rectangular structure, and the bottom plate 10 is a rectangular plate.

Specifically, the modular storage box has a rectangular structure. This regular geometric shape not only conforms to usage habits of people, facilitating easy gripping and placement, but also simplifies the manufacturing process, improves production efficiency, and enhances structural stability and assembly convenience.

In some embodiments of the present disclosure, the side portion includes a front plate 20 and a rear plate 30 arranged symmetrically front and back, and a left plate 40 and a right plate 50 arranged symmetrically left and right, where front and rear ends of the left plate 40 and the right plate 50 are each provided with a vertical groove having an opening, and left and right ends of the front plate 20 and the rear plate 30 are each provided with a vertical strip matching the vertical groove; and when all the vertical strips are inserted into the corresponding vertical grooves from the openings of the corresponding vertical grooves, the front plate 20, the left plate 40, the rear plate 30, and the right plate 50 are sequentially connected and enclose to form a vertically through rectangular structure.

Specifically, the side portion is assembled from four plates by means of insertion. By inserting the vertical strips of the front plate 20 and the rear plate 30 into the openings of the vertical grooves of the left plate 40 and the right plate 50, the four plates can be sequentially connected to form a vertically through rectangular structure. The fit between the vertical grooves and the vertical strips not only provides a firm connection but also facilitates disassembly, which is beneficial for subsequent maintenance or replacement. It should be noted that, in this embodiment, the front and rear ends of the left plate 40 and the right plate 50 are each provided with a vertical groove, and the left and right ends of the front plate 20 and the rear plate 30 are each provided with a vertical strip. Certainly, the front and rear ends of the left plate 40 and the right plate 50 can be each provided with a vertical strip, and the left and right ends of the front plate 20 and the rear plate 30 can be each provided with a vertical groove, such that the two configurations are interchangeable. In practical applications, the appropriate configuration can be selected according to specific structural requirements and assembly convenience, thereby achieving overall structural flexibility and diversity.

As shown in FIGS. 8-11, in some embodiments of the present disclosure, the vertical strip includes an integrally formed strip-shaped connecting portion 21, and strip-shaped left strip portion 22 and right strip portion 23, where the connecting portion 21 is connected to the corresponding front plate 20; the left strip portion 22 and the right strip portion 23 are respectively located on a left side and a right side of the connecting portion 21; a cross section of the vertical strip is in a T shape with a vertical portion corresponding to the connecting portion 21 and a horizontal portion corresponding to the left strip portion 22 and the right strip portion 23, where an area of the horizontal portion of the T shape corresponding to the left strip portion 22 has a large size, and an area of the horizontal portion of the T shape corresponding to the right strip portion 23 has a small size;

the vertical groove includes an integrally formed plate-shaped bottom member 41, and L-shaped left groove member 42 and right groove member 43, where the bottom member 41 is connected to the corresponding left plate 40, a vertical portion of the left groove member 42 is connected to a left side of the bottom member 41, a vertical portion of the right groove member 43 is connected to a right side of the bottom member 41, and a horizontal portion of the left groove member 42 and a horizontal portion of the right groove member 43 are arranged separately; a spacing between the horizontal portion of the left groove member 42 and the bottom member 41 is greater than a spacing between the horizontal portion of the right groove member 43 and the bottom member 41;

when the vertical strip is inserted into the corresponding vertical groove from the opening of the corresponding vertical groove, the left strip portion 22 slides along the left groove member 42, and the right strip portion 23 slides along the right groove member 43; and the connecting portion 21 is located in a gap between the horizontal portion of the left groove member 42 and the horizontal portion of the right groove member 43.

Specifically, the vertical strip includes an integrally formed connecting portion 21, a left strip portion 22, and a right strip portion 23, where the left strip portion 22 has a large size, and the right strip portion 23 has a small size. The vertical strip is used in conjunction with the vertical groove. The vertical groove includes an integrally formed bottom member 41, a left groove member 42, and a right groove member 43, where the groove members match the corresponding strip portions in size. When the vertical strip is inserted into the vertical groove from the opening of the vertical groove, the right strip portion 23 with a small size serves as a main guide component and can ensure smooth entry of the vertical strip into the vertical groove, thereby improving assembly smoothness; in addition, the right strip portion 23 provides auxiliary positioning during insertion to prevent shifting during insertion; and the left strip portion 22 with a large size serves as a main positioning component, closely fits the left groove member 42, and provides a larger contact surface and stronger mechanical support to achieve positioning and fixation, thereby enhancing post-assembly stability and positioning accuracy. Compared with a conventional left-right symmetrical insertion structure, the left-right asymmetrical design of the strip portions and their corresponding groove members can effectively avoid assembly difficulties caused by tight fit on both sides. The dimensional difference enables division of labor between guiding on one side and positioning on the other side, thereby balancing assembly smoothness and connection firmness, and significantly improving user experience.

In some embodiments of the present disclosure, the right strip portion 23 includes an upper strip segment 24 and a lower strip segment 25 respectively located at an upper end and a lower end of the connecting portion 21, the upper strip segment 24 and the lower strip segment 25 being arranged separately from each other; and the right groove member 43 includes an upper groove segment 44 and a lower groove segment 45 respectively located at an upper end and a lower end of the bottom member 41, the upper groove segment 44 and the lower groove segment 45 being arranged separately from each other.

Specifically, the right strip portion 23 includes an upper strip segment 24 and a lower strip segment 25 arranged separately up and down, where the upper strip segment 24 and the lower strip segment 25 have a same structure and are both strip-shaped. The right groove member 43 correspondingly includes an upper groove segment 44 and a lower groove segment 45 arranged separately up and down. The upper groove segment 44 and the lower groove segment 45 have a same structure and are both L-shaped. The upper strip segment 24 mates with the upper groove segment 44, and the lower strip segment 25 mates with the lower groove segment 45, thereby forming two guide points, which can accurately guide the vertical strip into the vertical groove while preventing assembly difficulties caused by excessive tightness of overall fit. Since a middle segment area of the right strip portion 23 has a gap, the connection strength between the vertical strip and the vertical groove in this area is mainly provided by the left strip portion 22 with a large size. In addition, the presence of this gap can effectively reduce material usage and overall product weight, enabling the modular storage box to balance structural rigidity and lightweight requirement.

Figure 12:
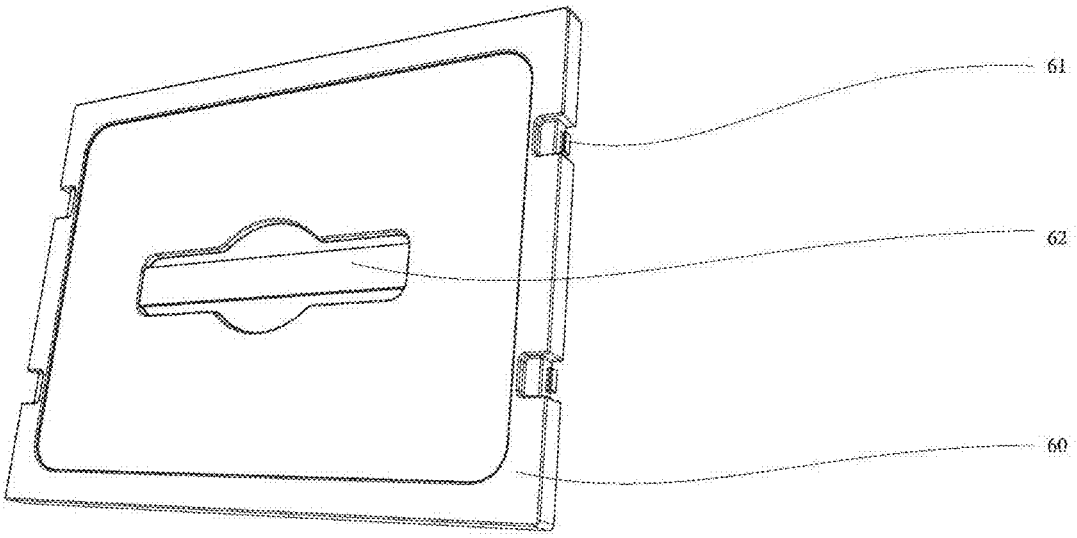
FIG. 12 is a schematic structural diagram of a top cover according to an embodiment of the present disclosure.

As shown in FIG. 12, in some embodiments of the present disclosure, the storage box further includes a top cover 60 for closing the integrated box body, where the top cover 60 is detachably connected to the side portion.

Specifically, the top cover 60 is configured to close an opening portion of the integrated box body, serving to protect items in the box and prevent dust and moisture. The top cover 60 is detachably connected to the side portion, thereby facilitating a user to access the items in the box while ensuring that the top cover 60 remains stably closed during normal use. The side portion, as a component connected to the top cover 60, can also be provided with a connecting member such as a buckle 33 or a magnetic fastener to achieve a stable connection and quick disassembly with the top cover 60.

In some embodiments of the present disclosure, an edge of the top cover 60 is provided with a protruding portion 61, and a side wall of the side portion is provided with a buckle 33 matching the protruding portion 61; and when the buckle 33 is engaged with the protruding portion 61, the top cover 60 and the side portion are connected by engagement.

Specifically, the engagement connection between the protruding portion 61 and the buckle 33 can ensure that the top cover 60 is stably fixed to the side portion, effectively preventing accidental loosening. This connection enables easy mounting and quick disassembly, significantly enhancing user experience.

In some embodiments of the present disclosure, the protruding portion 61 includes at least one pair of left-right symmetrically arranged protruding members, and the buckle 33 includes at least one pair of left-right symmetrically arranged engaging members matching the protruding members.

Specifically, the protruding portions 61 are distributed in pairs and arranged symmetrically left and right, and the buckles 33 correspond to the protruding portions 61 in number and position to ensure accurate fit between the two. Through the cooperation between the left-right symmetrical protruding members and engaging members, the top cover 60 and the side portion can form a stable engagement connection, which ensures balance and uniform force distribution of the integrated box body, and avoids loosening caused by non-uniform force on one side, thereby enhancing the overall structural stability.

In some embodiments of the present disclosure, a top surface of the top cover 60 is provided with a handle 62.

Specifically, the provision of the handle 62 facilitates the user to grip the top cover 60, thus significantly improving the convenience of using the modular storage box, and making it particularly suitable for scenarios where the top cover 60 needs to be frequently opened and closed.

According to the modular storage box provided in the present disclosure, stable assembly of the integrated box body is achieved through a vertical bidirectional locking structure between the side portion and the bottom plate 10. The plates of the side portion are further precisely positioned and firmly connected by the cooperation between the vertical strips and the vertical grooves, thereby enhancing the overall structural stability and assembly accuracy. The overall structure of the product balances connection firmness, structural rigidity and lightweight design, fully meeting daily usage requirements and achieving high feasibility.

It should be noted that the technical solutions among the various embodiments may be combined with one another, but must be based on the implementation by those of ordinary skill in the art. When the combination of the technical solutions is contradictory or may not be implemented, it should be considered that such combination of the technical solutions does not exist and is not within the scope of protection of the present disclosure.

The above descriptions are merely some or preferred embodiments of the present disclosure, and neither the text nor the drawings should be construed to limit the scope of protection of the present disclosure. Any equivalent structural changes made using the contents of the specification and drawings of the present disclosure under an overall concept of the present disclosure, directly/indirectly applied in other related technical fields, are included within the scope of protection of the present disclosure.

What is claimed is:

1. A modular storage box, comprising a bottom plate and a side portion, wherein the bottom plate has a planar structure, and the side portion has a vertically through structure; an edge of the bottom plate is provided with an insertion groove having an upward opening; a side wall of the insertion groove protrudes from an upper surface of the bottom plate and is provided with a first wedge member; a spacing between a wedge surface of the first wedge member and the side wall of the insertion groove increases gradually from top to bottom; a flat surface of the first wedge member is perpendicular to the side wall of the insertion groove and connected to a lower part of the wedge surface of the first wedge member; a bottom surface of the side portion is provided with an insertion strip matching the insertion groove; at least one of a left end and a right end of the bottom surface of the side portion forms a projecting portion configured to establish a blocking relationship with an upper edge of the side wall of the insertion groove to prevent the side portion from further moving downward; a position of a side wall at a lower end of the insertion strip corresponding to the first wedge member is provided with a second wedge member; a spacing between a wedge surface of the second wedge member and the side wall at the lower end of the insertion strip increases gradually from bottom to top; a flat surface of the second wedge member is perpendicular to the side wall at the lower end of the insertion strip and connected to an upper part of the wedge surface of the second wedge member;

when the insertion strip on the side portion is inserted into the insertion groove from the opening of the insertion groove in the bottom plate, the wedge surface of the second wedge member slides along the wedge surface of the first wedge member until the flat surface of the second wedge member is limited by the flat surface of the first wedge member; in addition, the projecting portion of the bottom surface of the side portion is blocked by the upper edge of the side wall of the insertion groove, such that the side portion and the bottom plate closely enclose to form an integrated box body;

wherein the integrated box body has a rectangular structure, and the bottom plate is a rectangular plate;

wherein the side portion comprises a front plate and a rear plate arranged symmetrically front and back, and a left plate and a right plate arranged symmetrically left and right; front and rear ends of the left plate and the right plate are each provided with a vertical groove having an opening, and left and right ends of the front plate and the rear plate are each provided with a vertical strip matching the vertical groove; and when all the vertical strips are inserted into the corresponding vertical grooves from the openings of the corresponding vertical grooves, the front plate, the left plate, the rear plate, and the right plate are sequentially connected and enclose to form the vertically through structure of the side portion, the vertically through structure being rectangular;

the vertical strip comprises an integrally formed strip-shaped connecting portion, and strip-shaped left strip portion and right strip portion; the connecting portion is connected to the corresponding front plate; the left strip portion and the right strip portion are respectively located on a left side and a right side of the connecting portion; a cross section of the vertical strip is in a T shape with a vertical portion corresponding to the connecting portion and a horizontal portion corresponding to the left strip portion and the right strip portion, wherein an area of the horizontal portion of the T shape corresponding to the left strip portion has a large size, and an area of the horizontal portion of the T shape corresponding to the right strip portion has a small size;

the vertical groove comprises an integrally formed plate-shaped bottom member, and L-shaped left groove member and right groove member; the bottom member is connected to the corresponding left plate, a vertical portion of the left groove member is connected to a left side of the bottom member, a vertical portion of the right groove member is connected to a right side of the bottom member, and a horizontal portion of the left groove member and a horizontal portion of the right groove member are arranged separately; a spacing between the horizontal portion of the left groove member and the bottom member is greater than a spacing between the horizontal portion of the right groove member and the bottom member;

when the vertical strip is inserted into the corresponding vertical groove from the opening of the corresponding vertical groove, the left strip portion slides along the left groove member, and the right strip portion slides along the right groove member; and the connecting portion is located in a gap between the horizontal portion of the left groove member and the horizontal portion of the right groove member.

2. The modular storage box according to claim 1, wherein a through hole is formed in a position of a bottom wall of the insertion groove corresponding to the first wedge member.

3. The modular storage box according to claim 1, wherein the right strip portion comprises an upper strip segment and a lower strip segment respectively located at an upper end and a lower end of the connecting portion, the upper strip segment and the lower strip segment being arranged separately from each other; and the right groove member comprises an upper groove segment and a lower groove segment respectively located at an upper end and a lower end of the bottom member, the upper groove segment and the lower groove segment being arranged separately from each other.

4. The modular storage box according to claim 1, further comprising a top cover for closing the integrated box body, wherein the top cover is detachably connected to the side portion.

5. The modular storage box according to claim 4, wherein an edge of the top cover is provided with a protruding portion, and a side wall of the side portion is provided with a buckle matching the protruding portion; and when the buckle is engaged with the protruding portion, the top cover and the side portion are connected by engagement.

6. The modular storage box according to claim 5, wherein the protruding portion comprises at least one pair of left-right symmetrically arranged protruding members, and the buckle comprises at least one pair of left-right symmetrically arranged engaging members matching the protruding members.

7. The modular storage box according to claim 4, wherein a top surface of the top cover is provided with a handle.

* * * * *